United States Patent [19]

Davison

[11] Patent Number: 4,528,907

[45] Date of Patent: Jul. 16, 1985

[54] PRINT HEAD WITH DUAL EXCHANGEABLE HOT INKING ROLLS

[75] Inventor: Charles F. Davison, Brookfield, Ill.

[73] Assignee: Norwood Marking & Equipment Co., Inc., Downers Grove, Ill.

[21] Appl. No.: 623,821

[22] Filed: Jun. 22, 1984

[51] Int. Cl.[3] ..... B41F 31/30

[52] U.S. Cl. ..... 101/219; 101/352

[58] Field of Search ..... 101/209, 352, 351, 348, 101/335, 208, 216, 219; 400/218, 219, 219.1, 221

[56] References Cited

U.S. PATENT DOCUMENTS

| | | | |
|---|---|---|---|
| 1,443,164 | 1/1923 | Bracken | 101/5 |
| 2,162,812 | 6/1939 | Harrold et al. | 101/351 |
| 3,274,932 | 9/1966 | Caza | 101/351 |
| 3,712,215 | 1/1973 | Cunningham | 101/208 X |
| 3,731,621 | 5/1973 | Neckel | 101/209 X |
| 3,871,294 | 3/1975 | Kagari et al. | 101/142 X |
| 4,342,520 | 8/1982 | Isobe et al. | 400/221 |
| 4,380,194 | 4/1983 | Carter et al. | 101/35 |

FOREIGN PATENT DOCUMENTS

| | | | |
|---|---|---|---|
| 55-866 | 4/1980 | Japan | 101/352 |
| 167488 | 12/1981 | Japan | 400/221 |
| 2790 | 1/1982 | Japan | 400/249 |
| 2103546 | 2/1983 | United Kingdom | 400/221 |

OTHER PUBLICATIONS

U.S. patent application Ser. No. 535,997 filed Sep. 26, 1983 (Davison).

*Primary Examiner*—Clifford D. Crowder

*Attorney, Agent, or Firm*—Hill, Van Santen, Steadman & Simpson

[57] ABSTRACT

A print head has a print roller carrying one or more type holders thereon for imprinting a work piece movable between the print roller and a support roller, and has dual hot ink rollers carried on an ink roller support member which is movable so as to simultaneously engage one of the ink rollers with the printer roller for inking the type thereon and to move the other ink roller to a position away from the printer roller permitting replacement of the ink roller without stopping the printing operation. The support member carrying the dual ink rollers may be manually movable or may be movable by a hydraulically actuated rack and pinion or by an air cylinder. The printer roller may be equipped with a counter for providing a signal after a specified number of revolutions indicating a change of inking rollers is necessary. In the automatic embodiments, the counter may be connected to a control unit for automatically moving the support member to engage a fresh inking roller.

23 Claims, 7 Drawing Figures

FIG 5
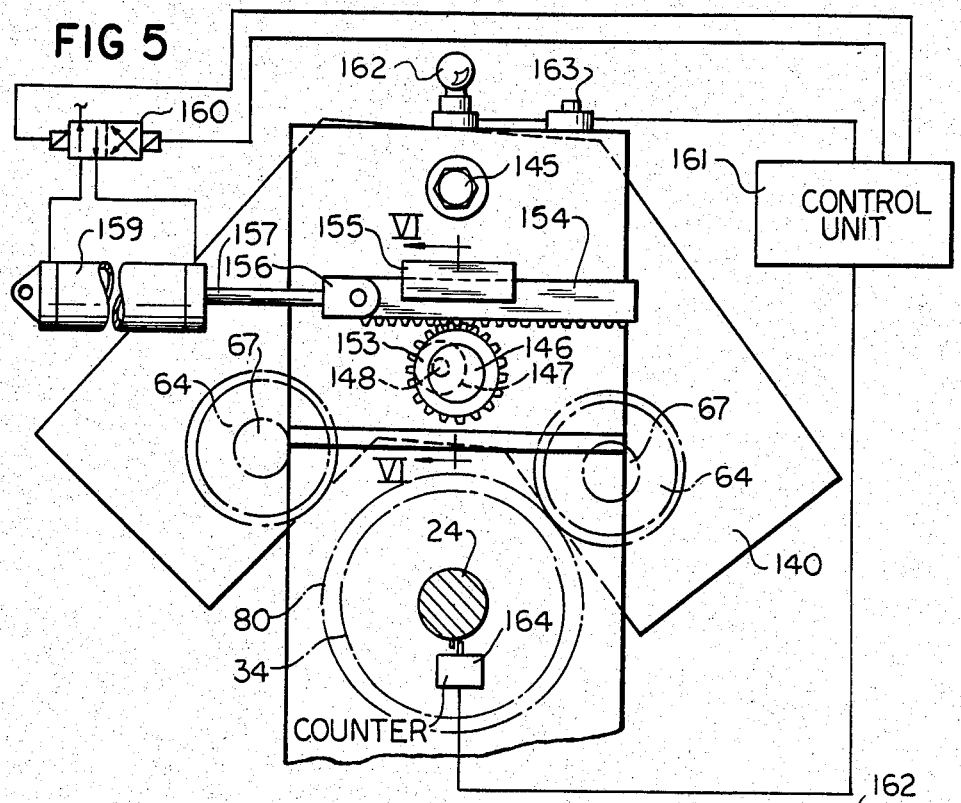
FIG. 6
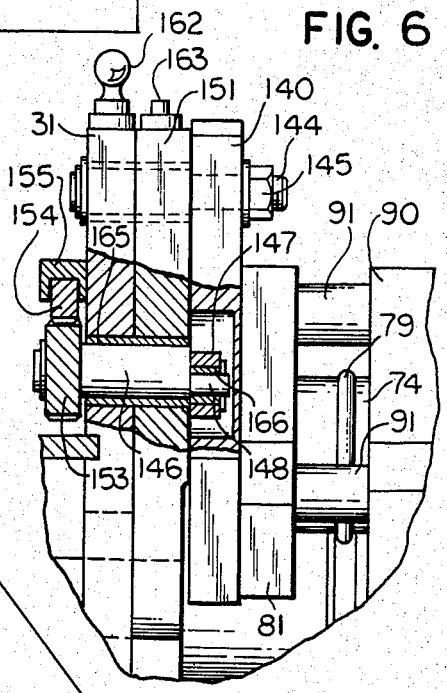
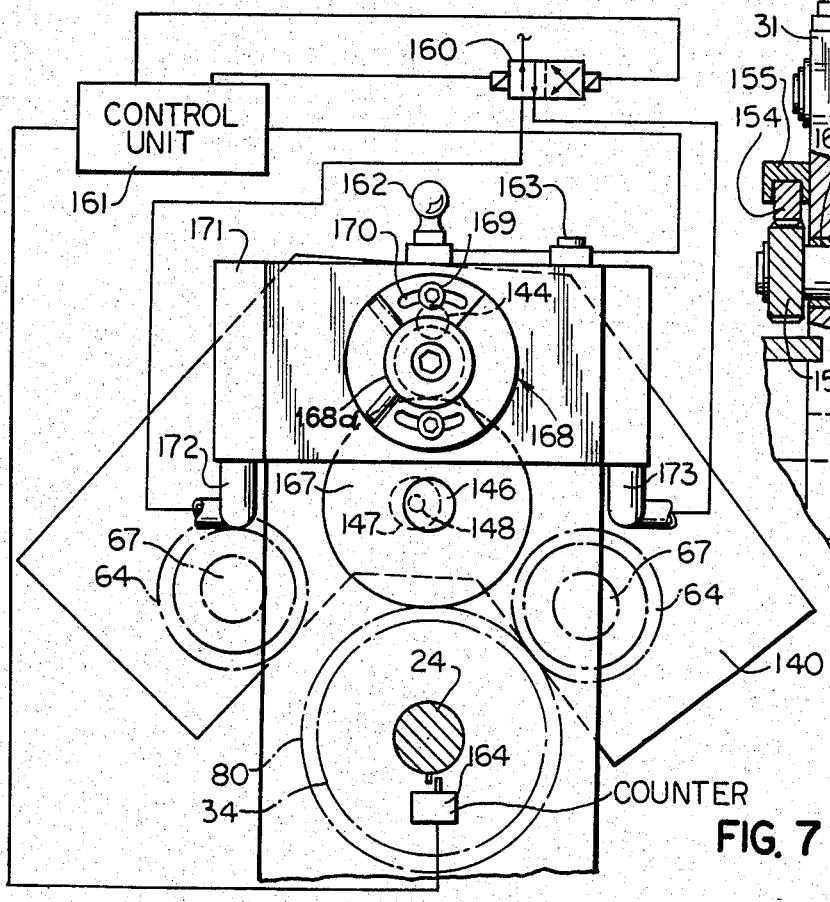
FIG. 7

PRINT HEAD WITH DUAL EXCHANGEABLE HOT INKING ROLLS

BACKGROUND OF THE INVENTION

The present invention relates to marking devices, particularly rotary head markers for imprinting a moving work piece such as a strip of bag material or the like which permits a fresh inking roller to be inserted without stopping the printing operation.

Rotary head printers are employed for imprinting information on a work piece such as bag material in strip form and the like. A common type of such rotary head printers has a rotatably driven head carrying printing in the form of type bars with the type exposed at the circumference of the print head for successively contacting an inking roll and the work piece, which is moved between the driven head or printing roll and a backing roll. Such marking units may be utilized in association with a packaging or filling machine, or may be employed to imprint film or similar material which is then wound onto a roll for subsequent use. This type of marker or printer is used to print small or selected areas of preprinted film panels in the form of a film strip consisting of a longitudinally extending series of such panels, which will subsequently be cut to form the individual faces of bags or packages.

It is necessary to change the type carried by the print head with some frequency for different imprinting runs. It is also necessary from time to time to vary the size or the transverse location of the imprinting, or the spacing of the imprints along the length of the work piece. It is also necessary to frequently change the inking roller which contacts the type face at least once per revolution of the printer roller so as to supply a fresh coat of ink to the type face. Such rollers must be changed, for example, due to wear or for changing ink colors or to replenish the ink supply.

A rotary print head is disclosed in the co-pending application of Charles F. Davison, Ser. No. 535,997 filed Sept. 26, 1983. The apparatus disclosed therein provides, among other structural features and advantages, means for easily removing and retaining one or more type holders in the printer roll, means for adjusting the positions of various rolls for accommodating rolls of different sizes, and means for easily removing and replacing the ink roller. This apparatus, however, employs only a single inking roller and therefore operation of the printing unit must cease whenever an inking roller is to be removed and replaced. In many applications, such removal and replacement of the inking roller must be undertaken several times a day, such as after a specified number of printing impressions.

It is therefore an object of the present invention to provide a marking apparatus which permits easy and rapid replacement of an inking roller without disrupting the printing operation.

The above object is inventively achieved in a marking apparatus having dual inking rollers carried on a common support member, the support member being movable so as to position one of the ink rollers in inking engagement with the printer roller, while simultaneously positioning the other ink roller out of engagement with the print roller so as to permit replacement of that roller while the other roller continues to operate in the printing sequence.

In one embodiment of the apparatus, the support member carrying the dual inking rollers is connected to a manually actuatable lever having an eccentric cam thereon which is movable in a slot in the support member. As the lever is moved through an arc, the eccentric cam is rotated within the confines of the slot, causing the support member to move to one side or the other in order to place one of the dual inking rollers in inking engagement with the printer roller, while simultaneously moving the other roller out of engagement for replacement thereof.

In another embodiment of the invention, the eccentric cam is carried on the pinion of a rack and pinion arrangement, the rack being movable by a hydraulic cylinder.

In another embodiment, the eccentric cam is carried on a gear or toothed wheel in engagement with a rotary air cylinder.

In all of the embodiments, the printer roll may be equipped with a counter for providing a signal, such as a visual signal, after a specified number of revolutions, and therefore a specified number of printing impressions, of the printer roller, thereby designating that the inking roller currently in engagement with the printer roller should be replaced. Upon observing this signal, a worker can either manually move the lever to effect engagement of the fresh inking roller, or can actuate suitable controls for effecting operation of the hydraulic cylinder or the rotary air cylinder to achieve the same result.

In a further embodiment of the invention, the non-manually actuatable embodiments, namely the embodiments employing the hydraulic cylinder and the rotary air cylinder, may be equipped with a control unit to which the counter is connected for automatically effecting a changeover to the fresh inking roller upon the occurrence of a specified number of revolutions of the printer roll. The control unit may, for example, actuate a solenoid-controlled valve connected to the hydraulic cylinder or the rotary air cylinder. Upon successive occurrences of the specified count, the valve is actuated so as to cause the support member to move in a direction opposite to the direction in which it was previously moved upon attainment of the previous count.

BRIEF DESCRIPTION OF THE DRAWINGS

FIG. 5 is a front elevational view of the dual inking roller support member and the printer roll and a schematic electric, hydraulic circuit for controlling movement of the support member.

FIG. 6 is a partial sectional view taken generally along line VI—VI of FIG. 5.

FIG. 7 is a front elevational view of the dual inking roller support member and the printer roll with a schematic electric-pneumatic circuit diagram for controlling the movement of the support member.

DESCRIPTION OF THE PREFERRED EMBODIMENTS

Figure 1:
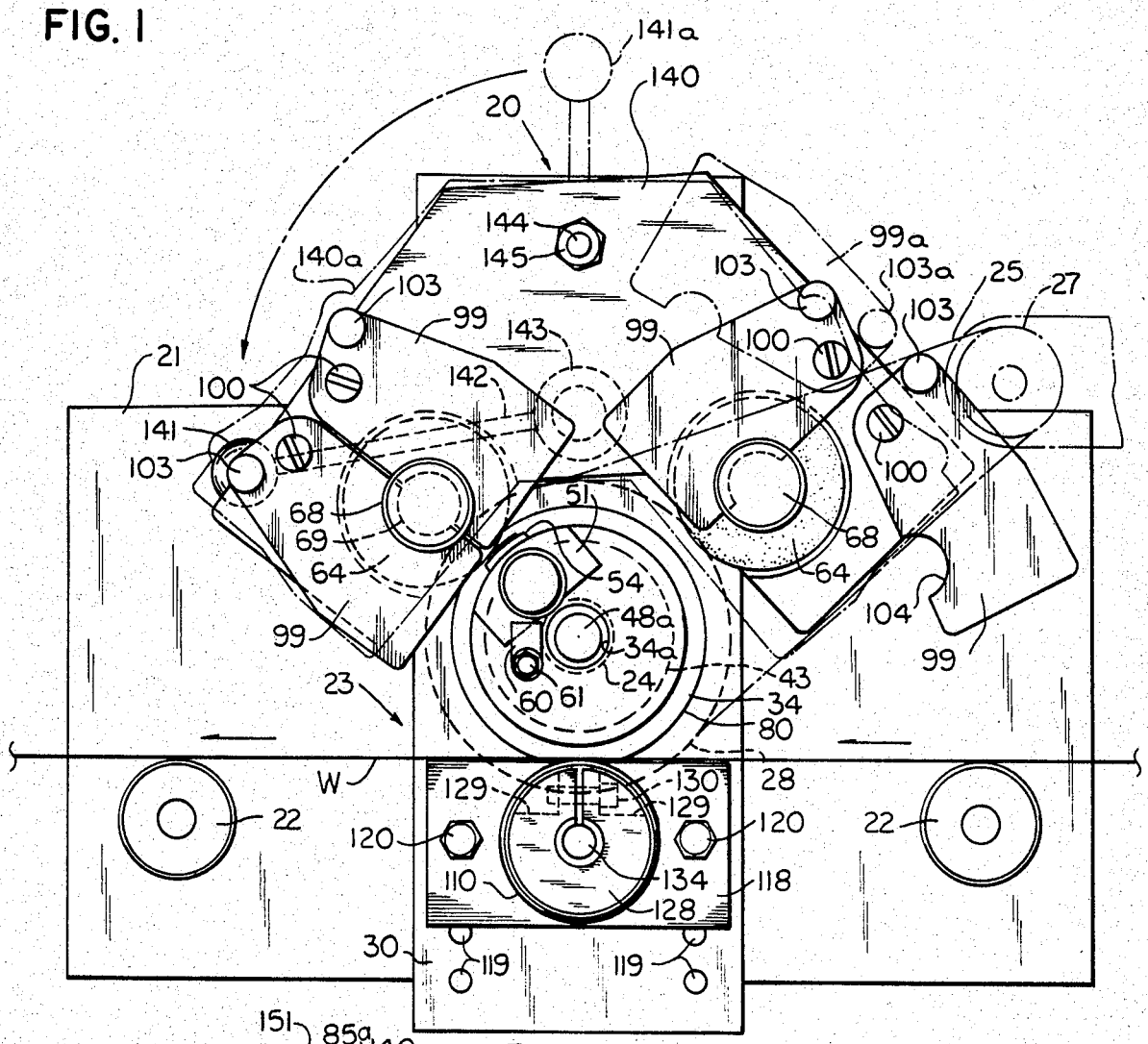
FIG. 1 is a front elevational view of a rotary marker having dual inking rollers constructed in accordance with the principles of the present invention.

A rotary head imprinter 20 (FIG. 1) is adapted to be carried by or in association with apparatus 21 which may support spaced apart guide rollers 22, one on each side of the imprinter 20 and over which a workpiece W such as carton flap, a web, film strip, bag making film web or strip material may be adapted to travel from any suitable source to a disposition point such as a winder, bag making machine, bag filling machine, or the like. For example, where the imprinter 20 is used in connection with bag forming and filling means, last minute information such as code dating or pricing may be imprinted in designated panel areas of a pre-printed bag making film. While the imprinter 20 is desirably adapted for continuous printing operation where the workpiece W is caused to run continuously through the imprinter, the imprinter is adapted to be operated intermittently where starting and stopping movement of the workpiece W is necessary for the particular type of utilization of the imprinted material.

In a preferred embodiment, the imprinter 20 comprises a frame 23 which rotatably supports a shaft 24 (FIG. 2) adapted to be driven rotatably by a drive assembly including an endless driving element such as a chain 25 which is driven as by means of a transmission 27 powered by any suitable means (not shown) which may be common to the means for driving the workpiece W. At the shaft 24, the driving power input chain 25 is trained over a sprocket 28 keyed to the shaft 24.

Antifriction bearings 29 support the shaft rotatably in spanning relation on and between spaced parallel vertical panels of the frame 23, comprising a rear panel 30 and a front panel 31 secured together along opposite vertical edges by means of spaced parallel vertical connecting panels 45 and 45*a* (FIG. 2) which extend in a front to rear direction and define with the panels 30 and 31 a chamber 33 through which the shaft 24 extends. The portion of the shaft extending rearwardly from the panel 30 carries the drive means sprocket 28, and a portion of the shaft which projects forwardly from the frame panel 31 has replaceably attached thereto a rotary print head 34.

For releasably mounting the print head 34 on the shaft 24, the forward end of the shaft carries integrally thereon, or at least functionally integrally, a print head mounting block 35 which also serves as a heater for the printing head. For this purpose the block 35 carries one or more cartridge type heating elements 37 connected to an electrical power or energy source through thermostat means 38 and terminal block means 39 on the block 35. Electrical wiring 40 for the heaters extends along a longitudinal channel 41 in the shaft perimeter and is connected to electrical take-off or slip rings 42 mounted on a dielectric sleeve 43 carried fixedly on the shaft 24 within the chamber 33. Electrical brushes 44 carried by a top closure panel 45 over the chamber 33 are electrically connected to a suitable power source at a junction box 47 mounted on the panel 45. The bottom of the chamber 33 is closed by the panel 45*a* which has edges engaged in grooves in the frame panels 30 and 31.

Figure 4:
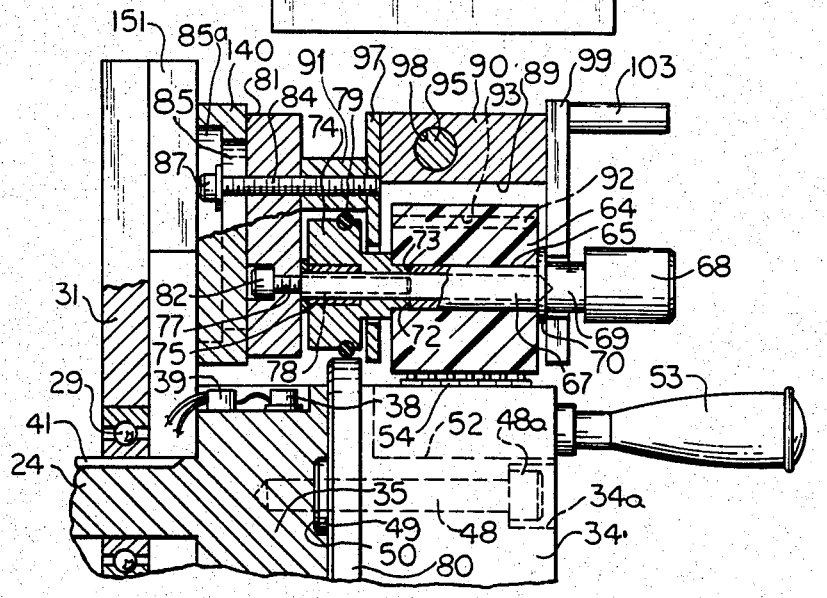
FIG. 4 is a sectional view taken generally along line IV—IV of FIG. 3.

Separable mounting of the print head 34 on the block 35 and concentric with the shaft 24, is desirably effected by engaging a rear face on the print head in heat transfer relation against a front face of the block 35. Securing of the print head to the mounting block is effected by means of a bolt 48 having a recessed head 48*a* (FIG. 4). Centering, coaxial alignment of the print head 34 with the shaft 24 is desirably indexed by means of a cylindrical boss 49 projecting rearwardly from the head 34 and received in a complementary cylindrical indexing socket 50 in the front face of the mounting block 35. To insure concentricity, the boss 49 fits in close slidable engagement in the socket 50.

Means are provided in the print head 34 for mounting a printing element such as a typeholder 51. More than one type holder may be employed, such as two holders 51 disposed at diametrically opposite sides of the head. Each of the type holders comprises a body of preferably elongate rectangular cross section adapted to be received slidably in respective axially extending and peripherally radially opening, rearwardly blind end socket slots 52 in the head 34 and each having an entrance at the front face of the print head for receiving the respective type holder 51 by an axially inward maneuver assisted by a respective handle 53 extending forwardly from each of the type holders. Type bars 54 are carried by the holders 51 and project from the perimeter of the head 34. Retention of the type holders 51 against radial displacement from the head 34 is effected by dovetail means comprising stepped shoulders 55 on each of the type holders engaged by cooperating radially inwardly facing retention shoulder 57 at the radially outer side of the socket 52 in each instance. The type holder 51 is axially retained by a latch 60 pivotable at one end about a bolt 61, which is tightened to hold the latch 60 in the holder-retaining position shown in FIG. 1. If more than one type holder 51 is employed, a latch arrangement as disclosed in the aforementioned application Ser. No. 535,997 may be used.

For inking the type faces of the type bars 54, there are provided two rotary inking rolls 64 which are mounted on a support member 140 connected to the frame panel 31 such that the rolls 64 are disposed above the print head 34 and on an axis parallel to the axis of the shaft 24 for rolling engagement with the printing bar type faces. The details of one such roll 64 are shown in FIG. 4, the other roll 64 being identically constructed. The roll 64 comprises a porous elastomeric sleeve impregnated with a heat liquifiable imprinting ink and its inner diameter 65 is adapted to be frictionally slidably received on a hub 67 having at its outer end a handle 68. Adjacent to the inner end of the handle 68 and spaced therefrom by a neck groove 69 is an integral annular thrust shoulder flange 70 on the hub 67 which is adapted to engage the outer end of the inking roll sleeve 64. At its inner end, the hub 67 has rearwardly extending clutch lugs 72 which interlock with complementary clutch slots 73 in the forward end of a driving wheel 74 having a bushing bearing 75 engaging rotatably about a cantilever axle 77 which extends through the wheel 74 and to a substantial extent into a journal bore 78 in the hub 67. Through this arrangement the hub 67 and thereby the inking roll 64 is adapted to be driven rotatably by engagement of a friction tread in the form of an elastomeric 0-ring 79 mounted on the perimeter of the wheel 74 and engaging a driving rim 80 integral with the inner end of the rotary printing head 34. The rim 80 is of suitable diameter in relation to effective type diameter to insure proper contact between the type and the inking roll.

Figure 2:
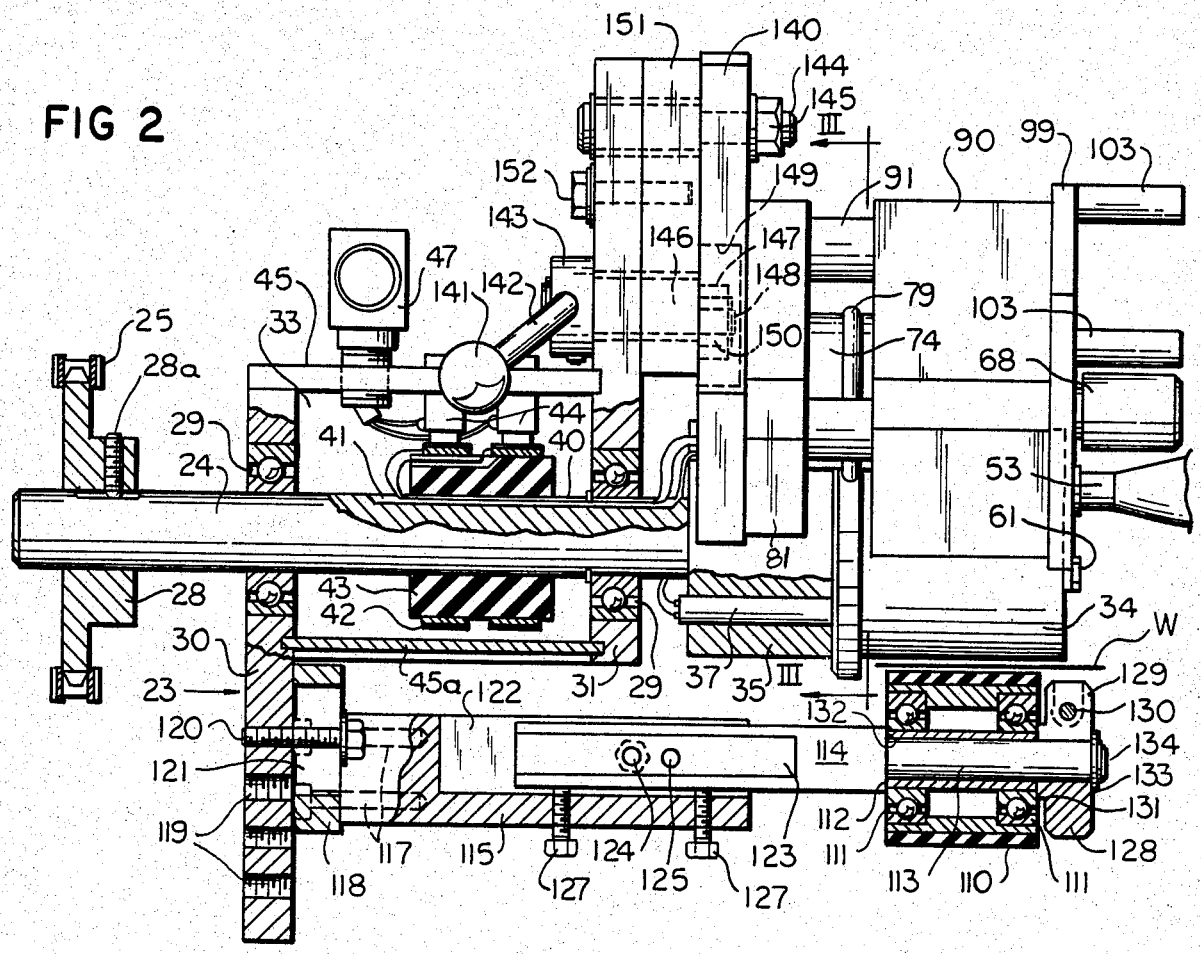
FIG. 2 is a side elevational view, partly in section, of the rotary marker shown in FIG. 1.

In a preferred arrangement as best seen in FIG. 4, the axle 77 is mounted to a plate 81 by an axle head 82 received in a recess therein. The support member 140 is connected to a mounting block 151 which is attached to an upstanding portion of the front wall frame plate 31 by a bolt 152 (FIG. 2). The plate 81 is held against the support member 140 by means of a pair of horizontally spaced attachment screws 84 which extend through vertical adjustment slots 85 in the support member 140 and are received in a plate 97 attached to a thermal block 90. Heads 87 of the screws 84 are accessible at the rear of the support member 140 and are adapted to be drawn up against a rim 85*a* of the vertical slots 85. Through this arrangement, the assembly comprising for each inking roll 64 is adapted to be vertically adjusted throughout a substantial range simply by loosening the screws 84 and moving the inking assembly up or down to accommodate print heads of different diameters.

For heating the inking roll 64, it is housed within a chamber 89 in the thermal block 90. Mounting of the thermal block 90 to the plate 81 is effected by the screws 84 extending through thermal barrier spacers 91. The spacers 91 are dimensioned to maintain a proper clearance between the plate 97 and the front face of the block 81 to accommodate the drive wheel 74. The spacers 91 are preferably formed from a material which is a poor heat conductor, such as stainless steel.

Means for maintaining controlled ink heating temperature within the chamber 89 comprise a pair of cartridge heaters 92 mounted in respective sockets 93 in the block 90 desirably adjacent to opposite side of the chamber 89 and near the lower opening from the chamber 89 where the inking roll 64 is exposed to contact with the indicia on the type bars 54. Energizing of the heaters 92 is effected through suitable electrical circuitry known to those skilled in the art. Heat output of the heaters 92 and thereby the ink heating action of the thermal block 90 is controlled as by means of a thermostatic thermal-control 95 connected in the heater circuit. In a preferred arrangement, the control 95 may be in the form of a cartridge having an externally accessible handle (not shown) by which the cartridge is adapted to be received in or removed from a socket 98 provided for this purpose in the block 90. It will be understood, of course, that the electrical circuit for the heaters 92 may be controlled in any preferred manner according to common practice, as also the electrical circuitry of the print head heater or heaters 37.

In order to facilitate initial mounting and retention of the inking roll 64 in the chamber 89, and to facilitate replacement of the inking roll due to wear or for replenishing the ink supply or changing the pigment color of the ink, or the like, each inking roll 64 is adapted to be carried into and removed from its chamber 89 on the hub 67. This hub, as already explained, is slidably received on the axle 77 and is clutchingly engageable with the driving wheel 74. Means for not only retaining the inking roll hub 67 within the chamber 89, but also for closing the front of the chamber 89, comprises a cooperating pair of pivotally mounted latch/door members 99 of mirror image construction and comprising flat coplanar plates mounted pivotally on the front face of the block 90. Respective pivots 100 at the upper ends of the members 99 and located adjacent to their meeting edges are located at such a position above the entrance into the chamber 89 that the plates can be swung from the full line closed position in FIG. 1 to the dash outline position 99*a* wherein the plates clear the entrance to the chamber 89 for full manipulative access to the inking roll 64. To implement this action each of the plates 99 has its edge adjacent to the pivots 100 shaped as on a radius complementary to the radius of curvature of the other plate to afford relative swinging movement clearance. The latch door plates 99 may be normally biased into the closing relation by any suitable biasing means (not further shown), such as by means of a tension spring.

At their upper ends and offset from the pivots 100, the latch door plates 99 have respective manipulating handles 103 which can be grasped by the thumb and forefinger of a hand and pulled toward one another whereby to swing about the pivots 100 to position 103*a* for opening the entrance into the chamber 89. Intermediately along the length of their meeting edges, the plates 99 have respective notches 104 for clearing the neck 69 of the hub handle 68 whereby in the closed relation of the members 99 they act as a latch engaging at the outer side of the collar flange 70 for retaining the hub 67 and thereby the inking roll 64 in place within the chamber 89. It will be observed in FIG. 2 that as thus latched in place, the inking roll 64 is held in its axial operating position between the shoulder flange 70 and a complementary shoulder on the driving wheel 74.

For supporting the workpiece W in position to be imprinted by the indicia on the type bars 54 carried by the print head 34, a backing roller 110 is mounted rotatably under the print head as visualized in FIGS. 1 and 2. In a desirable form, the roller 110 is rubber covered and supported on antifriction bearings 111 mounted about a tubular eccentric 112 supported on a spindle shaft or axial 113 projecting as an extension forwardly from a mounting bar 114 and desirably in one piece with this bar. The bar 114 is supported by a cantilever arm 115 secured at its rear end as by means of screws 117 to a mounting plate 118 which is elongated horizontally (FIG. 1) and at its opposite end portions overlaps respective vertically extending series of tapped bolt holes 119. Attachment screws 120 extend through vertical adjustment slots 121 in the end portions of the plate 118 and are selectively threadedly engaged in the bolt holes 119. Through this arrangement the mounting plate is adapted to be attached at various elevations to the frame plate 30 by selection of the bolt holes 119, as shown in FIGS. 2 and 1, for accommodating different diameters of print heads.

After a general or coarse vertical adjustment of the backing roller assembly has been effected by selection of the appropriate bolt holes 119, fine adjustment can be effected by vertically adjusting the mounting plate 118 with respect to the bolts 120 along the slots 121, and tightening of the bolts 120 then holds the mounting plate 118 at the desired elevation.

Additional fine or trimming adjustments of the backing roll 110 are adapted to be effected by having the axle shaft bar 114 rockably mounted on the arm 115. For this purpose, the bar 114 is received in a longitudinally extending upwardly opening slot 122 in the forward end portion of the arm 115, with parallel flatted sides 123 of the bar 114 slidably engaging side walls defining the slot 122. A pivotal pin 124 may be in the form of a screw, as shown, extending through and between the side walls defining the slot 122 and through a selected one of a pair of transverse journal bores 125 extending through the bar 114 between the flats 123 and in longitudinally spaced relation along the bar. Adjustment of the vertical attitude of the bar 114 is adapted to be effected and maintained by means of a pair of cooperating set screws 127 threaded upwardly, at longitudinally spaced points and at opposite sides of the pivot 124, through the arm 115 into the root of the slot 122 and into engagement with the underside of the bar 114.

After a coarse vertical adjustment and a secondary vertical adjustment has been effected by means of the screws 120, and a first stage fine adjustment has been effected by means of the set screws 127, a final fine adjustment is adapted to be effected by means of the eccentric 112. The final adjustment is desirable to obtain the optimum backing attitude of the backing roll 110 to the imprinting indicia of the type bars 54 of the print head 34. To facilitate the eccentric adjustment, it is provided on one end with a knob 128 which also serves as a locking clamp and for this purpose has a longitudinally extending slot 129 therein extending entirely through to the tubular bore of the eccentric 112 with which the knob is preferably formed integrally in one piece. By tightening a drawup locking screw 130 extending across the slot 129 of the split knob, the knob is adapted to be clamped firmly onto the axle shaft 113. At its inner end, the knob 128 is desirably provided with a rearwardly projecting limited contact shoulder 131 which is adapted in cooperation with a cooperating shoulder 132 on the bar 114 to maintain the backing roller 110 in proper alignment with the print head 34. For security purposes, the outer end portion of the axle shaft 113 may be provided with a snap ring groove 133 within which a retaining snap ring 134 is adapted to be received.

As stated above, the two inking rolls 64 are mounted on the support member 140 which is movable about a pivot bolt 144, retained by a nut 145, so as to position one of the inking rolls 64 in engagement with the type bars 54 carried in the type holder 51 so as to supply a fresh coat of ink thereto upon each revolution thereof.

In the manually actuatable embodiment shown in FIG. 1 and FIG. 2, movement of the support member 140 about the pivot bolt 144 is accomplished by a lever 141 having a shank 142 and a boss 143. The lever 141 is movable from a neutral position 141*a*, indicated in dashed lines in FIG. 1, at which position neither inking roll 64 is in contact with the type bars 54, through an arc of approximately 100 degrees to the position indicated by the solid lines in FIG. 1 and FIG. 2, wherein the left inking roll 64 as viewed in FIG. 1 is in contact with the type bars 54. Although not shown, it will be understood that movement of the lever 141 through an arc of approximately 100 degrees in the opposite direction will cause engagement of the right inking roll 64 with the type bars 54. When the lever 141*a* is in the neutral position, the support member is in the neutral position 141*a* indicated by dashed lines in FIG. 1.

Figure 3:
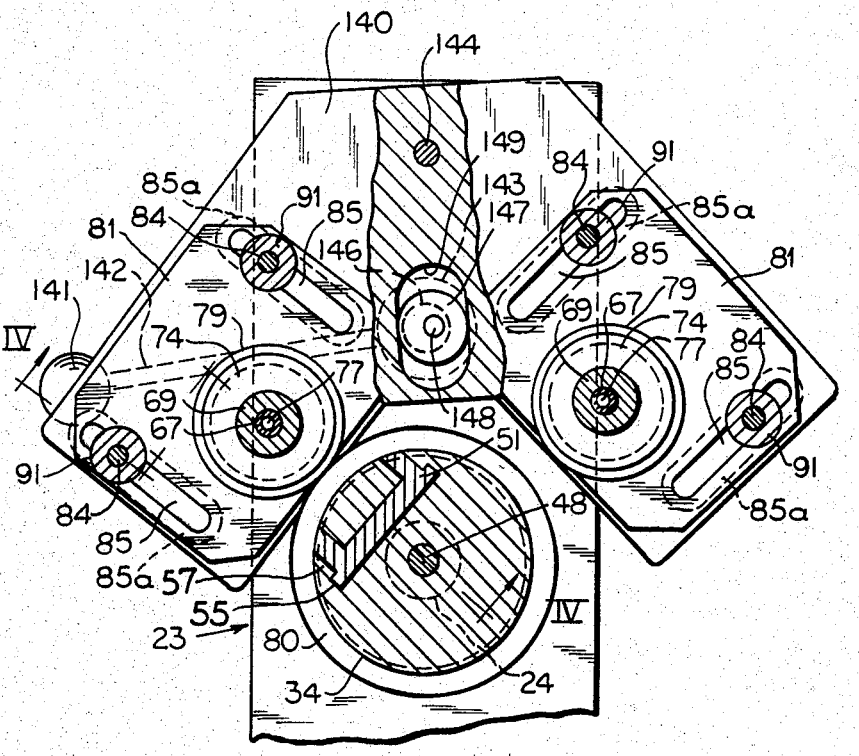
FIG. 3 is a partial sectional view taken along line III—III of FIG. 2.

Movement of the support member 140 is effected by means of an eccentric cam roller 147 which is mounted on a pin 148 connected to a shaft 146 having a free end surrounded by the boss 143 and prevented from rotation within the boss 143 by any suitable means, such as by a set screw. The cam roller 147 is held on the pin 148 by a retaining washer 166 or other suitable means. The shaft 146 extends through a bore 149 in the panel 31 and a spacer 151 disposed between the panel 31 and the support member 140. As best seen in FIG. 3, the support member 140 has a slot 149 within which the eccentric cam roller 147 moves as the lever 141 is rotated through an arc. The cam roller 147 pushes against the edges of the slot 149 so as to cause movement of the entire supporting member 140 in the desired direction.

The manually actuatable embodiment shown in FIGS. 1 and 2 can be operated by a worker in one of two modes. The worker can simply move the lever 141 by hand to one or the other extreme position so as to engage one of the inking rolls 64 with the type bars 54 after the passage of specified period of time, whereupon the disengaged ink roll 64 can be replaced with a fresh ink roll. Alternatively, the marker may be provided with a counter, preferably for counting the number of revolutions of the rotary print head 34 which can provide a visual, audio or other type of signal after a specified number of revolutions indicating the need to shift the support member 140 to engage a fresh inking roll 64, whereupon the worker can manually move the lever 141.

Such a counter is shown in the automatic embodiments of FIGS. 5, 6 and 7. In the embodiment of FIG. 5, shown partially in section in FIG. 6, movement of the support member 140 is accomplished by a generally horizontally movable rack 154 having teeth engaging teeth on the periphery of a pinion 153. The rack 154 is guided in a channel 155. The pinion 153 is connected to the shaft 146 on which the eccentric cam roller 147 is mounted so that movement of the support member 140 is effected as described above. Movement of the rack 154 is caused by a hydraulically actuated piston and cylinder arrangement 159 having a connecting rod 157 attached at a linkage 156 to the rack 154. The piston and cylinder arrangement 159 is operated by a solenoid-controlled valve 160 shown in FIG. 5 in position for causing movement of the rack 154 in the direction of the horizontal arrow so as to cause the right inking roll 64 to be in inking engagement with the type carried on the rotary print head 34. The rotary print head 34 is equipped with a counter 164 which is advanced upon each revolution of the rotary print head 34. Upon the attainment of a specified count, corresponding to a selected number of priting impressions, the counter 164 supplies a signal to a control unit 161. The control unit 161 supplies a signal to the valve 160 to alternately move the ports of that valve so as to cause movement of the rack 154 in a direction opposite to the direction in which the rack 154 was moved upon attainment of the previous designated count. Simultaneously the control unit 161 supplies a signal to an indicator light 162 to inform a worker that the shift has automatically been undertaken and the disengaged inking roll 164 should be replaced. After the worker has replaced the disengaged inking roll 64, he or she depresses a reset button 163 so that the light 162 is de-energized and is therefore readied for the next attainment of the designated count in the counter 164. The counter 164 is automatically reset to zero or a beginning count upon the attainment of the designated count.

Another automatic embodiment is shown in FIG. 7 wherein a rotary air cylinder 168 of the type well known to those skilled in the art is employed to move the support member 140. In this embodiment, the rotary cylinder 168 has a driven element 168*a*, such as a wheel or a gear, which is in driving engagement with an intermediate wheel or gear 167, to which the shaft 146, on which the eccentric roller 147 is mounted, is connected. The rotary air cylinder 168 has one or more stops 169, each adjustable within a slot 170, for adjusting the limits of movement of the rotary air cylinder 168. The rotary air cylinder 168 is mounted in a block 171 to which conduits 172 and 173 are connected. The conduits 172 and 173 lead to the solenoid-actuated valve 160, which is operated as described above upon attainment of a specified count in the counter 164. Again, the control unit 161 supplies a signal to the valve 160 so as to cause the rotary air cylinder 168 to rotate in a direction opposite to the direction in which the cylinder 168 was rotated upon attainment of the previous specified count, and again the display light 162 is illuminated to indicate to a worker the necessity of changing the disengaged inking roll 64. After replacing the disengaged inking roll 64, the worker, as in the previous embodiment, presses the reset button 163 to de-energize the light 162.

Any suitable signal generating means may be employed in place of the counter 164 which measures either the passage of time or the number of revolutions or the number of impressions. Other modifications and changes may be suggested by those skilled in the art, however, it is the intention of the inventor to embody within the patent warranted hereon all changes and modifications as reasonably and properly come within the scope of his contribution to the art.

I claim as my invention:

1. A marking apparatus including a frame and a drive means and comprising:

a rotary print head mounted on a shaft rotatably supported by said frame and rotated by said drive means, said rotary print head carrying at least one printing element on a periphery thereof;

a backing roller and means for mounting said backing roller to said frame for supporting a workpiece between said rotary print head and said backing roller for imprinting on said workpiece by said printing element;

a support member connected at a pivot means to said frame, said pivot means and said shaft defining a line;

two spaced inking rolls releasably mounted on said support member on opposite sides of said line, each inking roll being positionable for engaging said printing element for applying ink thereto at respectively different angles from said line; and a means for moving said support member about said pivot means for simultaneously positioning one of said inking rolls for engagement with said printing element and positioning the other of said inking rolls out of engagement with said printing element for replacing said other of said inking rolls while continuously imprinting said workpiece.

2. A marking apparatus as claimed in claim 1 wherein said means for moving said support member is manually actuatable.

3. A marking apparatus as claimed in claim 1 further comprising:

a signal generating means for generating an electric signal after a selected number of impressions of said printing element on said workpiece.

4. A marking apparatus as claimed in claim 3 wherein said signal generating means is a counter for counting the revolutions of said rotary print head.

5. A marking apparatus as claimed in claim 3 further comprising a display means connected to said signal generating means for indicating the occurrence of said selected number of impressions.

6. A marking apparatus as claimed in claim 5 wherein said display means is a visual display.

7. A marking apparatus as claimed in claim 5 further comprising a reset means interconnected between said signal generating means and said display means for resetting said display means after the occurrence of said selected number of impressions.

8. A marking apparatus as claimed in claim 3 wherein said means for moving said support member is connected to said signal generating means and is automatically actuatable for moving said support member upon receipt of said electric signal.

9. A marking apparatus as claimed in claim 1 wherein said means for moving said support member comprises:

a second shaft rotatably supported by said frame;

a cam roller eccentrically mounted on a first end of second shaft and received in a slot in said support member; and a means for rotating said second shaft for rotating said cam roller within said slot thereby rotating said support member about said pivot means.

10. A marking apparatus as claimed in claim 9 wherein said means for rotating said second shaft comprises:

a rack and pinion supported on said frame, said second shaft being connected at a second opposite end to said pinion; and a means for moving said rack.

11. A marking apparatus as claimed in claim 10 wherein said means for moving said rack comprises:

a hydraulic piston and cylinder, said rack being connected to said piston; and a means for alternately supplying hydraulic fluid to opposite sides of a head of said piston for moving said piston and said rack in opposite directions upon successive movements thereof.

12. A marking apparatus as claimed in claim 11 wherein said means for alternately supply hydraulic fluid to opposite sides of said piston head is a solenoid-actuated valve.

13. A marking apparatus as claimed in claim 11 further comprising:

a counter for counter the number of revolutions of said rotary print head and for generating a signal upon the attainment of a selected count; and a control unit connected to said counter for energizing said means for alternately supplying hydraulic fluid to opposite sides of said piston head for causing said hydraulic fluid to be supplied to one side of said piston head for moving said support member in one direction.

14. A marking apparatus as claimed in claim 9 wherein said means for rotating said second shaft comprises:

a rotary air cylinder having a driven element;

a rotatable element connected to a second opposite end of said second shaft and supported by said frame in driving engagement with said driven element; and a means for actuating said rotary cylinder.

15. A marking apparatus as claimed in claim 14 wherein said means for actuating said rotary cylinder is a solenoid-actuated valve.

16. A marking apparatus as claimed in claim 14 further comprising:

a counter for counting the number of revolutions of said rotary print head and for generating a signal upon the attainment of a selected count; and a control unit connected to said counter for energizing said means for actuating said rotary cylinder for causing said rotary cylinder to rotate in opposite directions upon successive actuations thereof.

17. A marking apparatus as claimed in claim 9 wherein said means for rotating said second shaft is a manually accessible lever connected to a second opposite end of said second shaft.

18. A marking apparatus as claimed in claim 9 wherein said slot in said support member is vertically disposed beneath said pivot means.

19. A marking apparatus including a frame and a drive means and comprising:

a rotary print head mounted on a shaft rotatably supported by said frame and rotated by said drive means, said rotary print head carrying at least one printing element on a periphery thereof;

a backing roller and means for mounting said backing roller to said frame for supporting a workpiece between said rotary print head and said backing roller for imprinting on said workpiece by said printing element;

a support member connected at a pivot means to said frame and having a slot therein;

two spaced inking rolls releasably mounted on said support member, each inking roll being positionable for engaging said printing element for supplying ink thereto;

a second shaft rotatably supported by said frame and having a cam roller eccentrically mounted at a first end thereof, said cam roller being received in said slot in said support member; and a manually accessible lever connected to a second opposite end of said second shaft, said second shaft being rotatable upon movement of said lever through an arc for rotating said eccentric cam roller within said slot thereby rotating said support member about said pivot means for simultaneously positioning one of said inking rolls for engagement with said printing element and positioning the other of said inking rolls out of engagement with said printing element for replacing said other of said inking rolls while continuously imprinting said workpiece.

20. A marking apparatus including a frame and a drive means and comprising:

a rotary print head mounted on a shaft rotatably supported by said frame and rotated by said drive means, said rotary print head carrying at least one printing element on a periphery thereof;

a backing roller and means for mounting said backing roller to said frame for supporting a workpiece between said rotary print head and said backing roller for imprinting on said workpiece by said printing element;

a support member connected at a pivot means to said frame and having a slot therein;

two spaced inking rolls releasably mounted on said support member, each inking roll being positionable for engaging said printing element for supplying ink thereto;

a second shaft rotatably supported by said frame and having a cam roller eccentrically mounted at a first end thereof, said cam roller being received in said slot in said support member;

a rack received in a guide means connected to said frame;

a pinion connected to a second opposite end of said second shaft and supported by said frame in driving engagement with said rack;

a hydraulic cylinder and piston for moving said rack, said piston being connected to said rack and having a piston head;

a valve means for alternately supplying hydraulic fluid to opposite sides of said piston head for moving said piston and said rack in opposite directions;

a counter for counting the number of impressions of said printing element on said workpiece and for generating a signal upon attainment of a selected count; and a control means interconnected between said counter and said valve means for supplying an actuating signal to said valve means upon receipt of said signal from said counter for moving said piston and said rack for rotating said pinion for rotating said cam roller within said slot, thereby rotating said support member about said pivot means in a direction opposite to rotation of said support member upon attainment of an immediately preceding selected count.

21. A marking apparatus as claimed in claim 20 further comprising:

a display means connected to said control means for indicating each movement of said support element upon receipt of said signal by said control means from said counter; and a reset means connected to said display means for resetting said display means after attainment of each said selected count.

22. A marking apparatus including a frame and a drive means and comprising:

a rotary print head mounted on a shaft rotatably supported by said frame and rotated by said drive means, said rotary print head carrying at least one printing element on a periphery thereof;

a backing roller and means for mounting said backing roller to said frame for supporting a workpiece between said rotary print head and said backing roller for imprinting on said workpiece by said printing element;

a support member connected at a pivot means to said frame and having a slot therein;

two spaced inking rolls releasably mounted on said support member, each inking roll being positionable for engaging said printing element for supplying ink thereto;

a second shaft rotatably supported by said frame and having a cam roller eccentrically mounted at a first end thereof, said cam roller being received in said slot in said support member;

a rotary air cylinder having a driven element rotatable in opposite directions;

a rotatable element connected to a second opposite end of said second shaft and supported by said frame in driving engagement with said driven element;

a valve means for actuating said rotary cylinder for rotating said driven element in opposite directions upon successive actuations of said rotary cylinder;

a counter for counting the number of impressions of said printing element on said workpiece and for generating a signal upon attainment of a selected count; and a control means interconnected between said counter and said valve means for supplying an actuating signal to said valve means for driving said driven element for rotating said rotatable member for rotating said cam roller within said slot, thereby rotating said support member about said pivot means in a direction opposite to rotation of said support member upon attainment of an immediately preceeding selected count.

23. A marking apparatus as claimed in claim 22 further comprising:

a display means connected to said control means for indicating each movement of said support element upon receipt of said signal by said control means from said counter; and a reset means connected to said display means for resetting said display means after attainment of each said selected count.

* * * * *